US010024499B2

(12) United States Patent
Brenskelle

(10) Patent No.: US 10,024,499 B2
(45) Date of Patent: Jul. 17, 2018

(54) METHOD AND SYSTEM FOR CONTROLLING SLUGGING IN A FLUID PROCESSING SYSTEM

(71) Applicant: Chevron U.S.A. Inc., San Ramon, CA (US)

(72) Inventor: Lisa A. Brenskelle, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/386,482

(22) Filed: Dec. 21, 2016

(65) Prior Publication Data

US 2018/0172217 A1 Jun. 21, 2018

(51) Int. Cl.

| | |
|---|---|
| ***F17D 3/05*** | (2006.01) |
| ***F17D 1/00*** | (2006.01) |
| ***F17D 5/00*** | (2006.01) |

(52) U.S. Cl.

CPC ..... *F17D 3/05* (2013.01); *F17D 1/005* (2013.01); *F17D 5/00* (2013.01)

(58) Field of Classification Search

None

See application file for complete search history.

(56) References Cited

U.S. PATENT DOCUMENTS 5,256,171 A * 10/1993 Payne ..... B01D 19/0057 95/157
6,984,257 B2 * 1/2006 Heath ..... B01D 53/263 95/174
7,239,967 B2 7/2007 Havre
2006/0150749 A1 7/2006 Eken et al.
2007/0186770 A1 * 8/2007 Heath ..... C10L 3/10 95/179

(Continued)

FOREIGN PATENT DOCUMENTS

GB 2429797 3/2007

OTHER PUBLICATIONS

Courbot, A.; "Prevention of Severe Slugging in the Dunbar 16' Multiphase Pipeline"; OTC 8196, May 1996, pp. 445-452.

(Continued)

*Primary Examiner* — Mohammad Ali
*Assistant Examiner* — Bernard G Lindsay
(74) *Attorney, Agent, or Firm* — Karen R. DiDomenicis

(57) ABSTRACT

A method and system are provided for reducing the volume and/or frequency of slugging in a fluid processing system that includes a pipeline for conveying produced fluids and a vessel for receiving the produced fluids from the pipeline. A control valve is provided in the pipeline upstream of the vessel. A pressure sensor and/or a level sensor is coupled to the vessel. Pressure information from the pressure sensor and/or level information from the level sensor is sent to at least one master control loop in a cascade control scheme. The master control loop output determines a set point of a slave control loop coupled to the control valve to achieve a pressure setpoint or a level setpoint. The slave control loop, also referred to as a pseudo-flow controller, determines whether the control valve opening needs be modulated to achieve the setpoint of the slave control loop. A method is also provided for retrofitting an existing fluid processing system.

19 Claims, 6 Drawing Sheets

(56) References Cited

U.S. PATENT DOCUMENTS

| | | | | |
|---|---|---|---|---|
| 2009/0084976 | A1* | 4/2009 | Camilli | H01J 49/24 250/397 |
| 2009/0149969 | A1* | 6/2009 | Slupphaug | G05D 7/0635 700/42 |
| 2009/0173390 | A1 | 7/2009 | Slupphaug et al. | |
| 2012/0165995 | A1 | 6/2012 | Crawley et al. | |

OTHER PUBLICATIONS

Godhavn, John-Morten, et al.; "Increased Oil Production by Advanced Control of Receiving Facilities"; Elsevier IFAC Publications, 2005, pp. 567-572.

Godhavn, John-Morten, et al.; "New Slug Control Strategies, Tuning Rules and Experimental Results"; Journal of Process Control, vol. 15, 2005, pp. 547-557.

Slupphaug, O., et al.; "Active Slug Management"; SPE 96644, (2006), pp. 1-5.

* cited by examiner

METHOD AND SYSTEM FOR CONTROLLING SLUGGING IN A FLUID PROCESSING SYSTEM

FIELD

The present disclosure relates to a method to reduce the volume and/or frequency of slugging in a fluid processing system including a pipeline and a control valve upstream of a vessel for first receiving produced fluids.

BACKGROUND

In fluid processing systems in which both gas and liquid phases flow through a pipeline or conduit, slug flow or slugging can occur when a large volume of gas or of liquid known as a slug travels through the pipeline. When liquid or gas slugs exit the pipeline at a processing facility, they can be produced at a rate which exceeds the ability of the fluid handling equipment to accommodate. Slugging behavior can be categorized as hydrodynamic slugging, terrain slugging, riser slugging, or operational slugging. Combinations of these types of slugging behavior can also occur. Hydrodynamic slugging is a known multiphase flow regime that occurs at certain values of superficial gas and liquid velocities. Terrain slugging can be caused by the changes in elevation in a pipeline, e.g., in the case of subsea pipeline, a pipeline along an uneven seabed with large variations in elevation. The liquid phase accumulates at a low point until the pipe is filled with liquid at that point. Then, gas accumulates behind the liquid slug until sufficient pressure builds up to move the slug of liquid through the pipeline. Riser-based slugging is a special form of terrain slugging associated with pipeline risers used in offshore oil production. Liquid accumulates at a low point or a bend in the riser to form a liquid slug which is produced once sufficient gas pressure is built up behind it to push the liquid slug over the top of the riser. Operational slugging can be caused by operational changes, such as start-up of a wet gas facility, and is most often handled via ramp-up of the facility.

Various schemes have been tried to control slugging behavior in fluid processing systems, including subsea fluid processing systems. The accepted control approaches to the various categories of slugging are different, because the causes of the behaviors are different, although all result in slugging behavior. For hydrodynamic slugging, the use of a "pseudo-flow" controller in which fluid flow is calculated from an equation for volumetric liquid flow through a valve is the accepted conventional approach. For terrain slugging, the accepted approach is the use of pressure control, wherein the pressure is located upstream of the slug-forming area. For riser slugging, this is at the base of the riser. For both hydrodynamic and terrain slugging, the accepted control schemes for each usually modulate the control valve located upstream of the vessel(s) first receiving produced fluids (e.g., a separator, slugcatcher, free water knock-out, etc.).

Choke valves upstream of a vessel for first receiving produced fluids have been used as manual control valves in fluid processing systems to control slugging. However, such use of the choke valve to control slugging generally results in reduced production. Thus, there is a reluctance to use this to address slugging in practice. Slug control schemes are intended to control slugging behavior by reducing the size (in terms of volume) and/or frequency of slugging behavior, or eliminating it entirely. Maximum production occurs with the valve fully open, but this cannot control or prevent slugging.

Known field-demonstrated control schemes include "pseudo-flow" control, pressure control upstream of the slug forming area, pressure control upstream of the slug forming area cascaded to pseudo-flow control, and composite variable control. Each of these has practical disadvantages. The principle disadvantage of pseudo-flow slug control is that setpoint determination is difficult. Since the pseudo-flow is not an actual physical flow rate, determination of the setpoint is not obvious. Trial and error would be required to determine such a setpoint each time it would need to be adjusted. In the case of slug control via pressure control upstream of the slug-forming area, the principle disadvantage is the cost of the subsea sensor (since the low point is frequently located subsea) and lack of access to the subsea sensor should it fail. Composite variable control uses a calculated variable and therefore as is the case in pseudo-flow slug control, setpoint determination is difficult. It is also as yet unclear whether the underlying calculated variable may need to be periodically redeveloped, making its ongoing use onerous.

It would be desirable to have a mechanism for controlling all types of slugging, including terrain slugging and riser slugging, in a fluid processing system more simply and effectively than has been realized to date.

SUMMARY

In one aspect, a method is provided for reducing slugging volume and/or frequency in a fluid processing system including a pipeline for conveying produced fluids, a vessel in fluid communication with the pipeline for receiving the produced fluids, a control valve having a percent opening in the pipeline upstream of the vessel, a means for measuring or estimating density of the produced fluids, a pressure sensor and/or level sensor coupled to the vessel, and a differential pressure sensing means for measuring the differential pressure across the control valve. In one aspect, the method includes receiving pressure information from the pressure sensor in a master control loop that receives a pressure setpoint. In a slave control loop controlled by the master control loop, differential pressure information is received from the differential pressure sensing means, density information is received, and current control valve percent opening information is received. In the slave control loop, a pseudo-flow rate is calculated for use in the slave control loop according to the equation:

$$Q = Cv \times \sqrt{(\Delta P/\rho)}$$

where:

i. Q=the calculated pseudo-flow rate of the produced fluids;

ii. Cv=a control valve coefficient dependent on the percent opening of the control valve;

iii. ΔP=the differential pressure across the slug control valve; and iv. ρ=density of the produced fluids.

A pseudo-flow rate setpoint is determined by the master control loop using the difference between the pressure information received from the pressure sensor and the pressure setpoint. The slave control loop determines whether the percent opening of the control valve should be modulated to achieve the pseudo-flow rate setpoint using the difference between the calculated pseudo-flow rate and the pseudo-flow rate setpoint. Finally, the percent opening of the control valve is modulated responsive to the determination of the slave control loop.

In another aspect, the method includes receiving level information from the level sensor in a master control loop that receives a level setpoint. In a slave control loop controlled by the master control loop, differential pressure information is received from the differential pressure sensing means, density information is received, and current control valve percent opening information is received. In the slave control loop, a calculated pseudo-flow rate is calculated for use in the slave control loop according to the equation:

$$Q=Cv\times\sqrt{(\Delta P/\rho)}$$

A pseudo-flow rate setpoint is determined by the master control loop using the difference between the level information received from the level sensor and the level setpoint. The slave control loop determines whether the percent opening of the control valve should be modulated to achieve the pseudo-flow rate setpoint using the difference between the calculated pseudo-flow rate and the pseudo-flow rate setpoint. Finally, the percent opening of the control valve is modulated responsive to the determination of the slave control loop.

In one aspect, a fluid processing system is provided. The fluid processing system includes a pipeline for conveying produced fluids; a vessel in fluid communication with the pipeline for receiving the produced fluids; a control valve having a percent opening in the pipeline; a means for measuring or estimating density of the produced fluids; a pressure sensor or a level sensor coupled to the vessel; a differential pressure sensing means for measuring the differential pressure across the control valve; and at least one processor. One of the at least one processors is in communication with the pressure sensor or the level sensor coupled to the vessel and is configured to include a master control loop to determine a pseudo-flow rate setpoint using the difference between pressure or level information received from the pressure sensor or the level sensor, respectively, and a pressure or level setpoint. One of the at least one processors is in communication with the means for measuring or estimating density, the differential pressure sensing means and the control valve and is configured to include a slave control loop to calculate a calculated pseudo-flow rate according to the equation:

$$Q=Cv\times\sqrt{(\Delta P/\rho)}$$

In another aspect, a method for retrofitting a fluid processing system is provided. The method includes connecting the pressure sensor or the level sensor to a master control loop such that the master control loop can receive pressure or level information from the pressure sensor or level sensor, respectively. The master control loop is connected to a slave control loop such that the slave control loop is controlled by the master control loop. The slave control loop is further in communication with the control valve, the means for measuring or estimating density and the differential pressure sensing means such that the slave control loop can receive density information and differential pressure across the slug control valve from the means for measuring or estimating density and the differential pressure sensing means, respectively, and such that the slave control loop can send control signals to the control valve. The master control loop is configured to determine a pseudo-flow rate setpoint using the difference between the pressure or level information received from the pressure sensor or level sensor, respectively, and a pressure or level setpoint. The slave control loop is configured to calculate a calculated pseudo-flow rate according to the equation:

$$Q=Cv\times\sqrt{(\Delta P/\rho)}$$

The slave control loop is configured to determine whether the percent opening of the control valve should be modulated to achieve the pseudo-flow rate setpoint using the difference between the calculated pseudo-flow rate and the pseudo-flow rate setpoint. The method can further include installing a control valve having a percent opening in the pipeline if not already present, installing a densitometer for measuring density or a means of estimating density of the produced fluids if not already present; installing a pressure sensor or a level sensor coupled to the vessel if not already present; and installing a differential pressure sensing means for measuring the differential pressure across the control valve if not already present.

DESCRIPTION OF THE DRAWINGS

These and other objects, features and advantages of the present invention will become better understood with reference to the following description, appended claims and accompanying drawings where:

DETAILED DESCRIPTION

Figure 1:
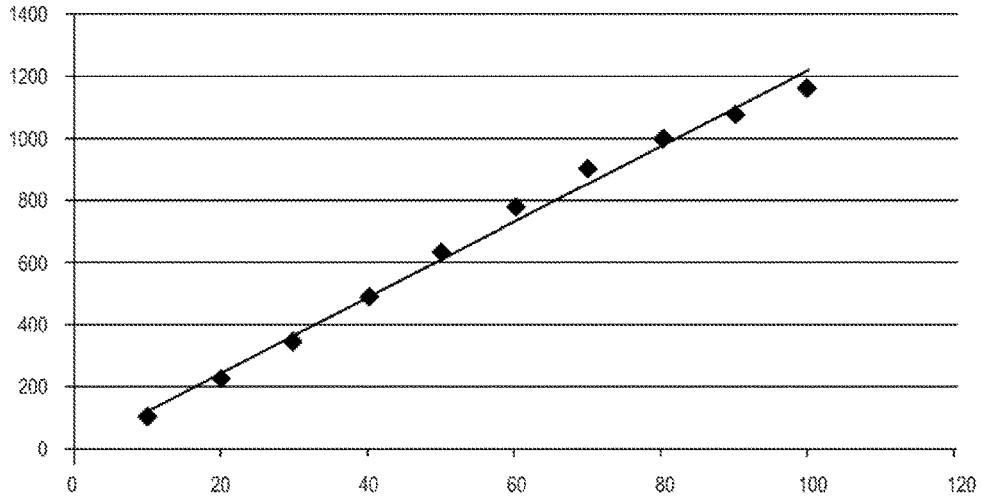
FIG. 1 is an exemplary plot of a relationship between control valve coefficient Cv and the percent opening of a control valve.

The slug control scheme of the present disclosure is used in a method for reducing the volume and/or frequency of slugging behavior in a pipeline system. The slug control scheme of the present disclosure is a cascade scheme. The term "cascade scheme" as used herein refers to a control scheme in which a master control loop output determines the setpoint of a slave control loop. In turn, the slave control loop modulates a final control element, e.g., a valve, variable speed drive or the like. A cascade scheme consists of two or more control loops logically linked together. In the simplest form of a cascade scheme, there are only a master control loop and a slave control loop, but more complex arrangements are possible.

In one embodiment, the pressure of the first vessel receiving produced fluids is used as information by the master control loop to determine the setpoint of the slave control loop.

In another embodiment, the liquid level of the first vessel receiving produced fluids is used as information by the master control loop to determine the setpoint of the slave control loop.

In yet another embodiment, both the pressure and the liquid level of the first vessel receiving produced fluids are used as information by the master control loops to determine the setpoint of the slave control loop.

Unlike the known control schemes as described herein in the Background, the master control loop in the control schemes of the present disclosure does not use a calculated value that is not understood by the average person operating such a facility. Pressure and level are typical process measurements that are well understood, and for which appropriate setpoints can easily be determined by an operator.

In one embodiment of the present disclosure, a controller, also referred to as a master control loop, in a processor receives pressure information, also referred to as current pressure, from a pressure sensor and compares the pressure information to a pressure setpoint, also referred to as the desired pressure, determined by an operator. Also in the cascade scheme is a pseudo-flow controller, also referred to as a slave control loop, in a processor. The controller and the pseudo-flow controller may reside on the same processor or separate processors in communication with one another. The controller uses the difference between the pressure as received from the pressure sensor and the pressure setpoint to determine a pseudo-flow setpoint to be sent to the pseudo-flow controller.

The term "pseudo-flow," also referred to as pseudo-flow rate, as used herein refers to a flow rate calculated using a control valve liquid flow equation.

The term "pseudo-flow controller" as used herein refers to a slave control loop that uses the control valve liquid flow equation to calculate the pseudo-flow rate. The pseudo-flow controller compares the pseudo-flow rate as calculated with a pseudo-flow setpoint as determined by the master control loop to determine a percent control valve opening to be sent to the control valve based upon the difference between the calculated pseudo-flow rate and the pseudo-flow setpoint. Thus in one embodiment, the master control loop is a pressure controller, which determines the setpoint of the slave control loop, i.e., the pseudo-flow controller. The slave control loop in turn determines the percent opening of the control valve. In other words, the pseudo-flow controller is activated responsive to the determination of the processor thus modulating the valve. In some cases, the pseudo-flow controller will determine that the percent opening of the control valve need not be changed.

The slug control scheme of the present disclosure uses a control valve liquid flow equation to calculate a pseudo-flow rate through a control valve rather than determining flow using flow measurement devices at each respective production line or on the pipeline(s) upstream of the receiving vessel. Since the slug control scheme does not use actual flow measurements, field determination of the pseudo-flow controller setpoint will be required, as would be understood by one skilled in the art.

The following is the pseudo-flow rate equation used. Although the following control valve liquid flow calculation does not accurately represent the true flow rate, given the multiphase nature of the fluids in the pipe, the calculation is repeatable. It is therefore sufficient for control purposes.

$$Q=Cv\times\sqrt{(\Delta P/\rho)}$$

where:

Q=Pseudo-flow rate

Cv=Control valve coefficient, dependent on the percent opening of the control valve ΔP=Pressure differential across the slug control valve ρ=fluid density The control valve coefficient Cv can be determined if the relationship between Cv and the percent control valve opening is known. This information is typically available from the control valve manufacturer. For example, one such relationship is illustrated in FIG. 1, wherein the y-axis represents the Cv values, and the x-axis represents the control valve percent opening.

The fluid processing system includes the control valve in a conduit upstream of a vessel for first receiving produced fluids. Pressure is detected by a pressure sensor located downstream of the valve, and the pressure information is sent to a processor on which the pressure controller resides. In one embodiment, the pressure controller and the pseudo-flow controller logic reside on a single processor which executes the logic, in another embodiment, the pressure controller and the pseudo-flow controller reside on separate processors which execute the logic associated with the cascade scheme, where the separate processors are in communication with one another.

Unlike the known control schemes as described herein in the Background, the master pressure controller in the control scheme of the present disclosure does not use a calculated value that is not understood by the average person operating a production facility. Pressure is a well-understood measurement and permits an operator to determine an appropriate setpoint.

Figure 2:
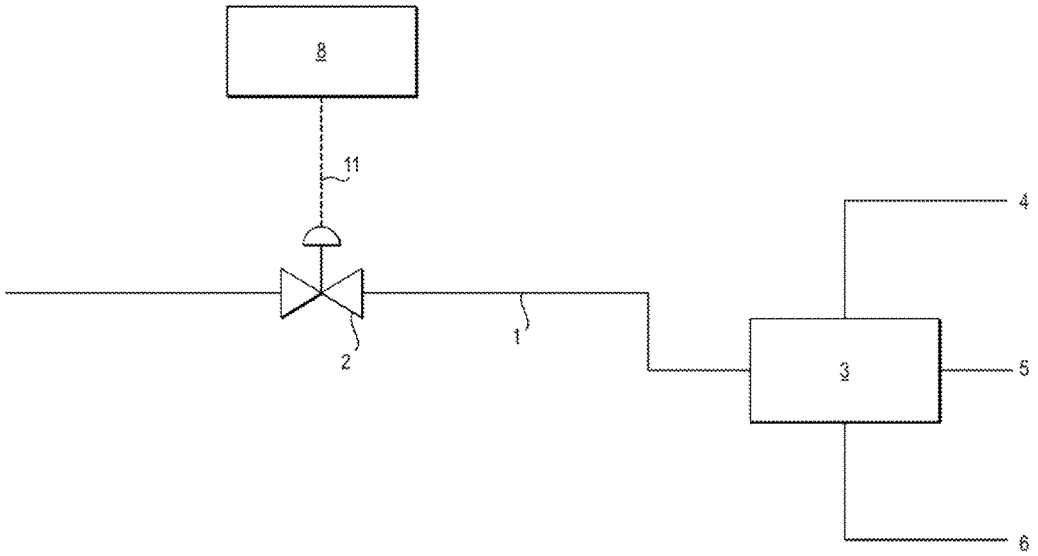
FIG. 2 (Prior Art)
FIG. 2 is a schematic diagram illustrating a fluid processing system according to the prior art.

FIG. 2 is a schematic diagram illustrating an example of a fluid processing system according to the prior art. Multiphase produced fluids travel through a pipeline also referred to as a conduit 1 from an upstream production location (not shown) through a control valve 2. A vessel 3 first receives the produced fluids. The produced fluids can be separated into a gas stream 4, a hydrocarbon liquids stream 5 and a water stream 6. Alternatively, the produced fluids can be separated into a gas stream 4, and a liquids stream. The control valve 2 can be controlled by a pseudo-flow controller residing on a processor 8 connected by line 11 to the topside control valve 2. In one embodiment, the control valve 2 can be a choke valve.

Figure 3:
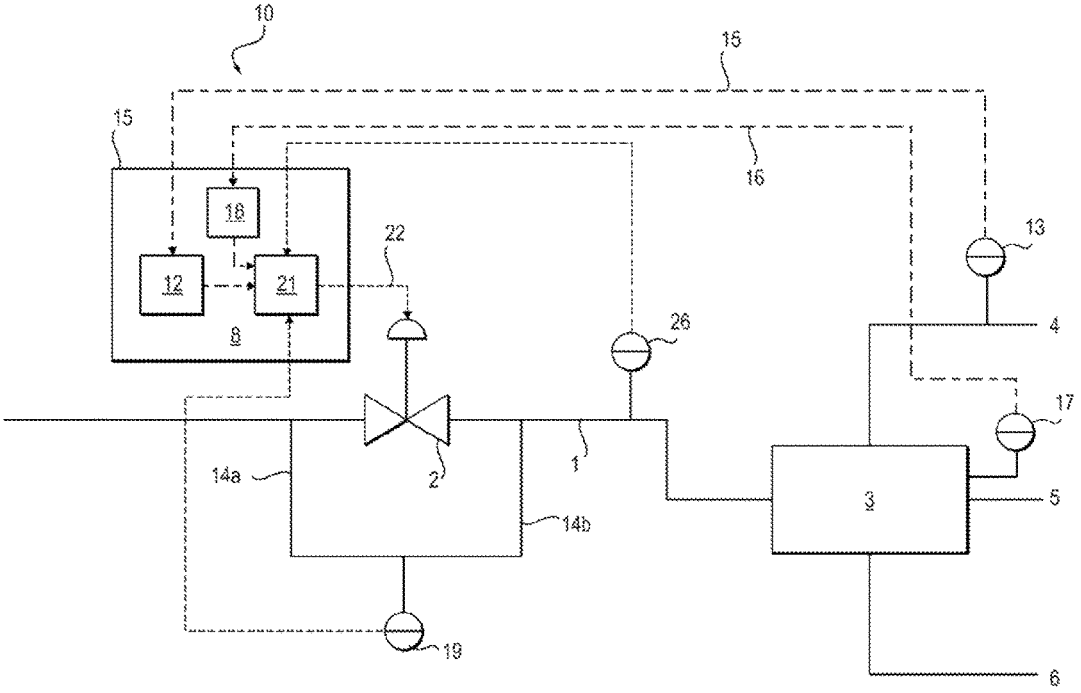
FIG. 3 is a schematic diagram illustrating a fluid processing system according to an exemplary embodiment.

FIG. 3 is a schematic diagram illustrating a fluid processing system 10 according to one embodiment including a pipeline 1 also referred to as a conduit 1 for transporting produced fluids from an upstream production location (not shown). Fluid flow through pipeline 1 is controlled by a control valve 2. A vessel 3 is provided for first receiving the produced fluids via pipeline 1. The vessel 3 is the first vessel for receiving produced fluids downstream of the control valve 2. The vessel 3 can be any vessel used to receive production fluids prior to further processing, e.g., separator, a slugcatcher, or a free water knock-out vessel. The produced fluids may be separated into a gas stream 4, a hydrocarbon liquids stream 5 and a water stream 6. Alternatively, the produced fluids may be separated into a gas stream 4 and a liquids stream (combining hydrocarbon liquids and water).

In one embodiment, a pressure sensor 13 is coupled to the vessel 3 such that it measures the pressure of the gas phase coming from the vessel 3 or within the vessel 3. Pressure information detected by the pressure sensor 13 is sent to a pressure controller, also referred to as a master control loop 12 (residing on a processor 8) via line 15. The pressure sensor 13 can be any type of pressure sensor. The processor 8 can be any type of processor associated with the control system.

In one embodiment, a differential pressure sensing means determines the pressure differential across the valve 2. The differential pressure sensing means sends differential pressure information to the pseudo-flow controller 21. In one embodiment, a differential pressure sensor 19 is coupled to the control valve 2 in order to measure the pressure differential across the valve 2, connected to the upstream side of the valve via line 14*a* and the downstream side of the valve via line 14*b*. Suitable differential pressure sensing means include any practical means for determining the differential pressure across the control valve 2. Alternative differential pressure sensing means can include the use of two different pressure sensors, one on each side of the control valve 2. Signals from the two different pressure sensors can be sent to the processor 8 which would calculate the differential pressure across the control valve 2 from the pressures measured by the two pressure sensors.

The fluid processing system 10 also includes a means 26 for measuring or estimating density ρ of the produced fluids in the pipeline 1. Density may be measured by a densitometer 26 or may be estimated based upon average fluid composition, a calculated value based upon current fluid composition, or a value determined based upon flow regime (i.e. liquid, gas or a mixture thereof). The densitometer 26 can be located either upstream or downstream of the control valve 2. The density ρ is used by the pseudo-flow controller 21 in the pseudo-flow rate calculation.

The pressure controller 12 is in communication with a pseudo-flow controller 21 residing on a processor 8 which is in turn in communication with the topside control valve 2 via line 22. The pressure controller 12 uses the pressure information to determine a set point of the pseudo-flow controller 21 to achieve a desired operating pressure. The pseudo-flow controller 21 can be activated in response to the determination of the pressure controller 12. The pressure controller 12 can deliver a control signal or cause a control signal to the pseudo-flow controller 21. In one embodiment, based on the determination of the pressure controller 12, the pressure controller 12 executes software to deliver the control signal to the pseudo-flow controller 21 which in turn controls the control valve 2.

The processor(s) 8 on which the pressure controller 12 and the pseudo-flow controller 21 reside can be any type of processor associated with conventional control systems. The pressure controller 12 and the pseudo-flow controller 21 may reside on the same processor 8 as shown or separate processors in communication with one another.

In one embodiment of the present disclosure, a level controller 18, also referred to as the master control loop, in processor 8 receives level information, also referred to as current level, from a level sensor 17 and compares the level information to a level setpoint, also referred to as the desired level, determined by an operator. Again referring to FIG. 3, a level sensor 17 is coupled to the vessel 3 such that a liquid level (total liquid level or oil level) in the vessel 3 is measured. Similar to the scheme described above using pressure information, level information detected by the level sensor 17 is sent to a level controller 18 (residing on processor 8) via line 16. The level sensor 17 can be any type of level sensor. Also in the cascade scheme is a pseudo-flow controller 21, also referred to as a slave control loop, in a processor 8. The level controller 18 is in communication with the pseudo-flow controller 21 residing on processor 8 which is in turn in communication with the control valve 2 via line 22. The level controller 18 uses the level information to determine a set point of the pseudo-flow controller 21 to achieve a desired operating level. The level controller 18 uses the difference between the level as received from the level sensor 17 and the level setpoint to determine a pseudo-flow setpoint to be sent to the pseudo-flow controller 21. Here the level controller 18 is the master loop, the output of which determines the pseudo-flow controller setpoint. The pseudo-flow controller 21 can be activated in response to the determination of the level controller 18. The level controller 18 can deliver a control signal or cause a control signal to the pseudo-flow controller 21. In one embodiment, based on the determination of the level controller 18, the level controller 18 executes software to deliver the control signal to the pseudo-flow controller 21 which in turn controls the topside control valve 2.

Figure 4:
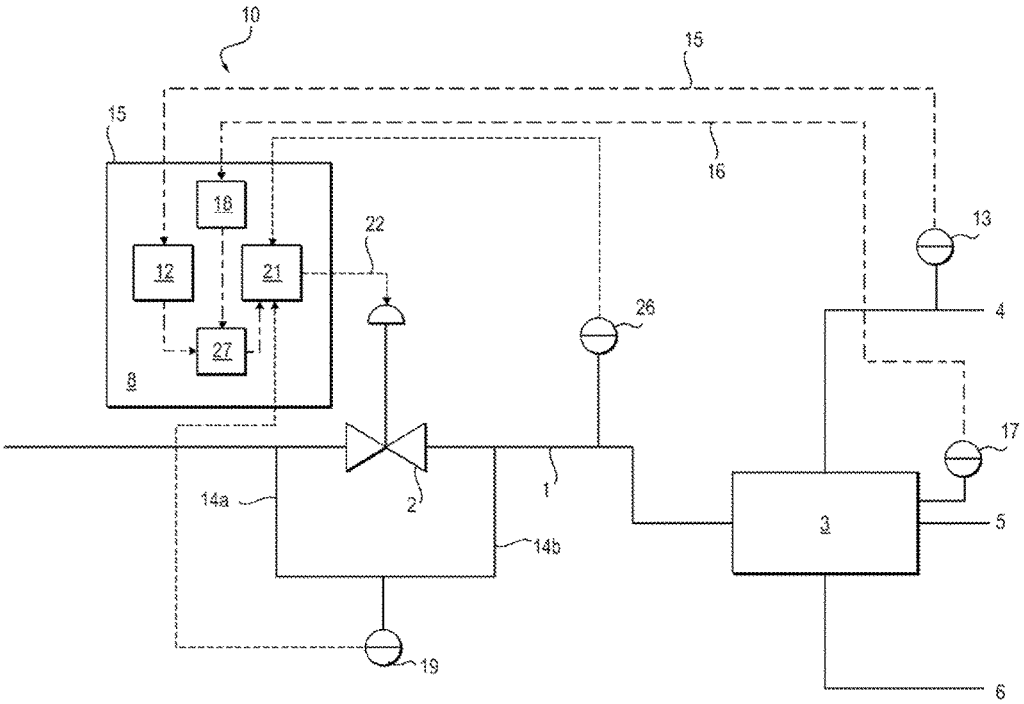
FIG. 4 is a schematic diagram illustrating a fluid processing system according to an exemplary embodiment.

In one embodiment of the present disclosure, as shown in FIG. 4, a pressure controller 12 in a processor 8 receives pressure information from pressure sensor 13 and a level controller 18 in a processor 8 receives level information from level sensor 17. As in the above-described embodiments, the desired pressure and level setpoints are determined by an operator. A low signal selector 27 selects the lower of the outputs of the pressure and level controllers 12 and 18. This lower output value determines the setpoint of the slave control loop. Note that outputs are normally in percent, and the setpoint so determined will match that percent of the pseudo-flow controller range, although other configurations are possible (such as the output being in the engineering units of the slave control loop). The pressure controller 12, level controller 18 and the pseudo-flow controller 21 may reside on the same processor 8 as shown or separate processors in communication with one another.

In one embodiment, an existing fluid processing system including pipeline and having a vessel for first receiving produced fluids can be retrofitted to reduce the volume and/or frequency of slugging behavior in the system. If not already installed, a control valve 2 can be installed in a conduit 1 upstream of the vessel 3. A processor 8 can be provided with a control scheme including a master control loop and a slave control loop, also referred to as a pressure controller 12 and/or a level controller 18 and a pseudo-flow controller 21, respectively. In another embodiment, the master control loop resides on one processor and the slave control loop resides on another processor in communication with one another. The pseudo-flow controller 21 is coupled to the control valve 2. A pressure sensor 13 can be installed such that it is located at the vessel 3. Likewise, a level sensor 17 can be installed such that it is located at the vessel 3. The pressure controller 12 is coupled to the pressure sensor 13. The level controller 18 is coupled to the level sensor 17. If not already present, a means 26 for measuring or estimating density 26 and a differential pressure sensing means 19 can also be installed in the existing system.

The vessel 3 for first receiving produced fluids can have a number of optional controllers (not shown) that can be used to control other variables, as known in the art, such as total liquid level in the vessel using a combination of a level controller and a control valve, liquid water and hydrocarbon levels in the vessel using a combination of water and hydrocarbon level controllers and water and hydrocarbon control valves, and pressure in the vessel 3 using a combination of a pressure controller and a pressure control valve.

The pressure sensor 12 and/or the level sensor 17, the processor 8 and the pseudo-flow controller 21 advantageously operate without the use of subsea instrumentation.

Using either of the systems shown in FIGS. 3 and 4, the severity of slugging behavior, in terms of volume and/or frequency of slugging can be reduced. In one embodiment, the volume of liquid and/or gas slugs in the fluid processing system is reduced as compared with an equivalent fluid processing system in which the choke valve is not controlled responsive to the determination of the processor. In one embodiment, the frequency of liquid and/or gas slugs in the fluid processing system is reduced as compared with an equivalent fluid processing system in which the choke valve is not controlled responsive to the determination of the processor. Slugging behavior in the fluid processing system can even be eliminated.

EXAMPLES

A simulation of the slug control scheme illustrated in FIG. 3 (as described herein above) was run to evaluate the scheme for hydrodynamic slugging. Modeling of exemplary pipeline slugging control schemes was done using UniSim® Design (USD) process modeling software available from Honeywell Process Solutions, a division of Honeywell International, Inc. (Morristown, N.J.). The slugging behavior was modeled using OLGA Dynamic Multiphase Flow Simulator software available from Schlumberger Ltd. (Houston, Tex.). The fluid processing systems modeled included subsea pipeline conveying fluids from subsea production wells into a topsides vessel, i.e., a slug catcher. The models of the slug control valve and receiving vessel were configured in UniSim® Design (USD) process modeling software. The control scheme was configured with a cascade of controllers, a spreadsheet calculation of the pseudo-flow and a choke valve actuated according to pseudo-flow controller output as shown in FIG. 3. The basic model configuration used integrated the OLGA simulation model into the USD process model, both synchronized to run in transient or dynamic, i.e., time-variant, mode. A spreadsheet calculation was performed by a processor in USD to calculate the pseudo-flow rate from the fluid density and differential pressure across the choke valve, as well as the current valve position. The pseudo-flow rate was used as the process variable input for the slave control loop, also referred to as the pseudo-flow controller. The pressure controller sent a setpoint to the pseudo-flow controller. The pseudo-flow controller executed logic to determine whether the opening position (i.e., percent open) of the choke valve needed to be modulated, based upon the difference between the process variable and the setpoint. The entire simulation and all components of it (i.e., simulated variables such as pressure and simulated controllers) were all run on a processor.

Figure 5:
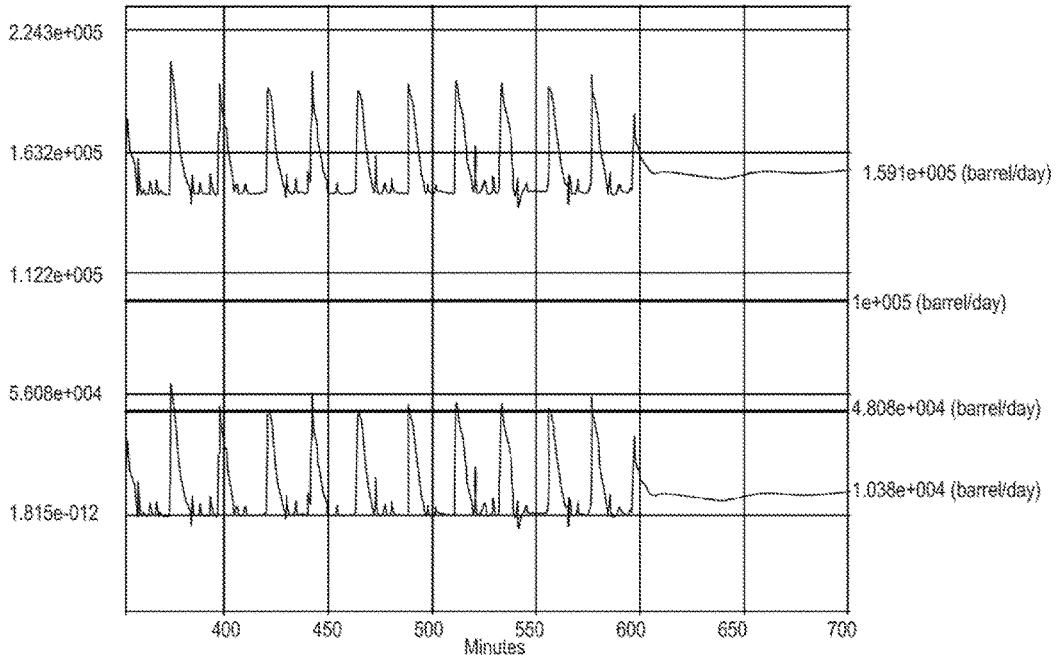
FIG. 5 is a plot illustrating the effects of a slug control scheme according to an exemplary embodiment on slugging behavior in a simulation of a processing facility.

FIG. 5 is a plot showing the individual line flow rates in barrels/day on three production lines, as well as the total flow rate for all three lines combined, as they route to the same set of first stage separators. The plot was generated by the UniSim® Design (USD) process modeling software. FIG. 5 shows hydrodynamic slugging behavior on one of the three production lines, causing total production from all three lines to fluctuate. Application of a cascade scheme using downstream pressure as the master controller setting the pseudoflow controller setpoint is demonstrated to eliminate the slugging behavior.

Similarly, a simulation of the slug control scheme illustrated in FIG. 4 (as described herein above) was run to evaluate the scheme for riser slugging. FIG. 4 shows the cascade scheme using the downstream pressure controller 12 and level controller 18 with a low signal selector 27 setting the setpoint of the pseudo-flow controller 21.

Figure 6:
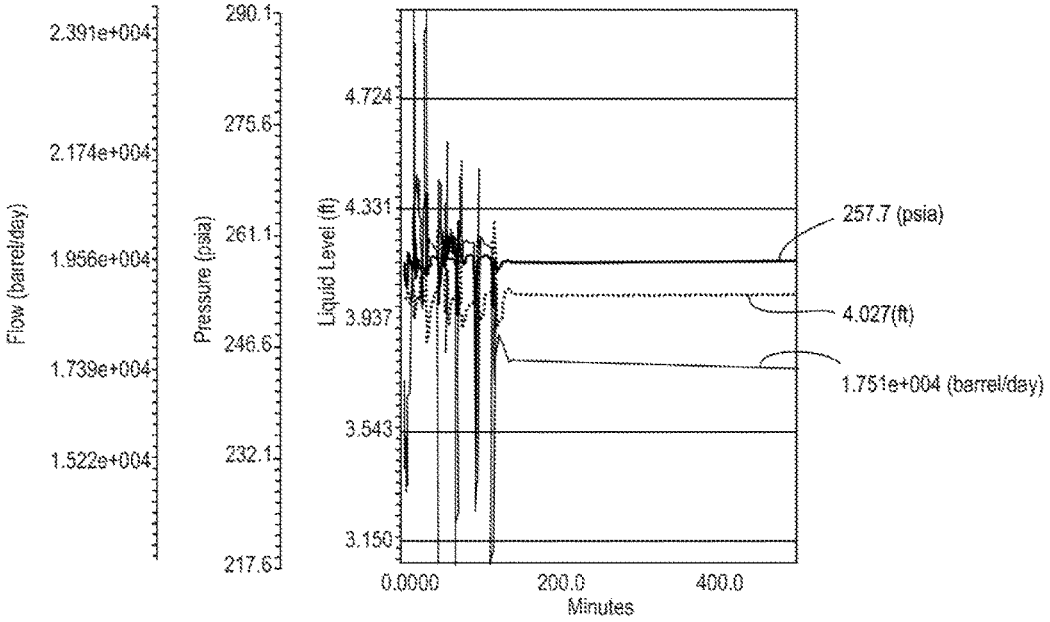
FIG. 6 is a plot illustrating the effects of a slug control scheme according to an exemplary embodiment on slugging behavior in a simulation of a processing facility.

FIG. 6 is a plot showing the resultant pseudoflow rate in barrels/day into the first receiving vessel, and the vessel pressure and level. The plot was generated by the UniSim® Design (USD) process modeling software. As can be seen, coincident with the use of the control scheme, riser slugging behavior ceased as indicated by large fluctuations in the plot of pseudoflow rate, level and pressure becoming stable.

Through the use of the system of the present disclosure, the volume and/or frequency of liquid and/or gas slugs in the fluid processing system can advantageously be reduced or eliminated. Furthermore, the volume and/or frequency of liquid and/or gas slugs in the fluid processing system can be reduced as compared with an equivalent fluid processing system in which no choke valve is present or the choke valve is fully open. Through the use of the system of the present disclosure, hydrodynamic or terrain slugging behavior in the fluid processing system can advantageously be eliminated or reduced, while facilitating the determination of a control valve opening over time.

Through the use of the systems of the present disclosure, the volume and/or the frequency of liquid and/or gas slugs in the fluid processing system can advantageously be reduced as compared with an equivalent fluid processing system in which the choke valve is at least partially open, i.e. partially open or fully open. The volume or the frequency of liquid and/or gas slugs in the fluid processing system can be reduced as compared with an equivalent fluid processing system in which no choke valve is present. Through the use of the system of the present disclosure, slugging behavior in the fluid processing system can advantageously be eliminated. The slugging behavior can be any type of slugging behavior, including terrain and hydrodynamic slugging.

It should be noted that only the components relevant to the disclosure are shown in the figures, and that many other components normally part of a fluid processing system are not shown for simplicity.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A method for reducing slugging volume and frequency in a fluid processing system, the method comprising:

a. receiving pressure information from a pressure sensor in a master control loop wherein the pressure sensor is coupled to a vessel selected from the group consisting of a separator, a slugcatcher, and a free water knock-out vessel in the fluid processing system and the vessel is in fluid communication with a pipeline in the fluid processing system for conveying produced fluids such that the vessel receives the produced fluids from the pipeline;

b. receiving a pressure setpoint in the master control loop;

c. receiving differential pressure information from a differential pressure sensing means for measuring differential pressure across a slug control valve in a slave control loop controlled by the master control loop wherein the slug control valve has a percent opening in the pipeline upstream of the vessel;

d. receiving density information from a means for measuring or estimating density of the produced fluids in the pipeline in the slave control loop;

e. receiving current slug control valve percent opening information in the slave control loop;

f. calculating a calculated pseudo-flow rate for use in the slave control loop according to the equation:

$$Q = Cv \times \sqrt{(\Delta P/\rho)}$$

where:

i. Q=the calculated pseudo-flow rate of the produced fluids;

ii. Cv=a slug control valve coefficient dependent on the percent opening of the slug control valve;

iii. ΔP=the differential pressure across the slug control valve; and iv. ρ=the density of the produced fluids;

g. determining by the master control loop a pseudo-flow rate setpoint using the difference between the pressure information received from the pressure sensor and the pressure setpoint;

h. determining by the slave control loop whether the percent opening of the slug control valve should be modulated to achieve the pseudo-flow rate setpoint using the difference between the calculated pseudo-flow rate and the pseudo-flow rate setpoint; and i. reducing the volume and frequency of hydrodynamic slugs, terrain slugs or a combination of hydrodynamic slugs and terrain slugs in the fluid processing system by modulating the percent opening of the slug control valve responsive to the determination of the slave control loop.

2. A method for reducing slugging volume and frequency in a fluid processing system, the method comprising:

a. receiving level information from a level sensor in a master control loop wherein the level sensor is coupled to a vessel in the fluid processing system and the vessel selected from the group consisting of a separator, a slugcatcher, and a free water knock-out vessel is in fluid communication with a pipeline in the fluid processing system for conveying produced fluids such that the vessel receives the produced fluids from the pipeline;

b. receiving a level setpoint in the master control loop;

c. receiving differential pressure information from a differential pressure sensing means for measuring differential pressure across a slug control valve in a slave control loop controlled by the master control loop wherein the slug control valve has a percent opening in the pipeline upstream of the vessel;

d. receiving density information from a means for measuring or estimating density of the produced fluids in the pipeline in the slave control loop;

e. receiving current slug control valve percent opening information in the slave control loop;

f. calculating a calculated pseudo-flow rate for use in the slave control loop according to the equation:

$$Q=Cv\times\sqrt{(\Delta P/\rho)}$$

where:

i. Q=the calculated pseudo-flow rate of the produced fluids;

ii. Cv=a slug control valve coefficient dependent on the percent opening of the slug control valve;

iii. ΔP=the differential pressure across the slug control valve; and iv. ρ=the density of the produced fluids;

g. determining by the master control loop a pseudo-flow rate setpoint using the difference between the level information received from the level sensor and the level setpoint;

h. determining by the slave control loop whether the percent opening of the slug control valve should be modulated to achieve the pseudo-flow rate setpoint using the difference between the calculated pseudo-flow rate and the pseudo-flow rate setpoint; and i. reducing the volume and frequency of hydrodynamic slugs, terrain slugs or a combination of hydrodynamic slugs and terrain slugs in the fluid processing system by modulating the percent opening of the slug control valve responsive to the determination of the slave control loop.

3. The method of claim 1 or claim 2, wherein the pipeline is at a subsea location and the slug control valve is at a topside location.

4. The method of claim 1 or claim 2, wherein the differential pressure sensing means is selected from the group consisting of a differential pressure sensor for measuring the differential pressure across the slug control valve, and a pair of pressure sensors for measuring the pressure at a location upstream of the slug control valve and a location downstream of the slug control valve such that the differential pressure across the slug control valve can be calculated from the measured pressures.

5. The method of claim 1 wherein the density is measured by a densitometer.

6. The method of claim 1 wherein the density is estimated by selecting a density value based on one of average produced fluid composition, current produced fluid composition, or produced fluid flow regime.

7. The method of claim 1, wherein each of the pressure information, differential pressure information and density information are converted to digital information readable by a processor.

8. The method of claim 1, wherein the pressure information, the differential pressure information and the density information are received by a single processor.

9. The method of claim 1, wherein the pressure information, the differential pressure information and the density information are received by multiple processors in communication with one another.

10. The method of claim 2, wherein each of the level information, differential pressure information and density information are converted to digital information readable by a processor.

11. The method of claim 2, wherein the level information, the differential pressure information and the density information are received by a single processor.

12. The method of claim 2, wherein the level information, the differential pressure information and the density information are received by multiple processors in communication with one another.

13. The method of claim 1 or claim 2, wherein the slug control valve is a choke valve.

14. A fluid processing system having reduced slugging volume and frequency, comprising:

a. a pipeline for conveying produced fluids;

b. a vessel selected from the group consisting of a separator, a slugcatcher, and a free water knock-out vessel in fluid communication with the pipeline for receiving the produced fluids;

c. a slug control valve having a percent opening in the pipeline;

d. a means for measuring or estimating density of the produced fluids in the pipeline;

e. a pressure sensor or a level sensor coupled to the vessel;

f. a differential pressure sensing means for measuring the differential pressure across the slug control valve; and g. at least one processor;

wherein one of the at least one processor is in communication with the pressure sensor or the level sensor coupled to the vessel and is configured to include a master control loop to determine a pseudoflow rate setpoint using the difference between pressure or level information received from the pressure sensor or the level sensor, respectively, and a pressure or level setpoint; and wherein one of the at least one processor is in communication with the means for measuring or estimating density of the produced fluids, the differential pressure sensing means and the slug control valve and is configured to include a slave control loop to:

calculate a calculated pseudo-flow rate according to the equation:

$$Q=Cv\times\sqrt{(\Delta P/\rho)}$$

where:

i. Q=the calculated pseudo-flow rate of the produced fluids;

ii. Cv=a slug control valve coefficient dependent on the percent opening of the slug control valve;

iii. ΔP=the differential pressure across the slug control valve; and iv. ρ=the density of the produced fluids; and determine whether the percent opening of the slug control valve should be modulated to achieve the pseudo-flow rate setpoint using the difference between the calculated pseudo-flow rate and the pseudo-flow rate setpoint; and reducing the volume and frequency of hydrodynamic slugs, terrain slugs or a combination of hydrodynamic slugs and terrain slugs in the fluid processing system by modulating the percent opening of the slug control valve responsive to the determination of the slave control loop.

15. The fluid processing system of claim 14, wherein the pipeline is at a subsea location and the slug control valve is at a topside location.

16. The fluid processing system of claim 14, wherein the slug control valve is a choke valve.

17. The fluid processing system of claim 14, wherein the density is measured by a densitometer.

18. A method for reducing slugging volume and frequency in a fluid processing system comprising:

a. receiving pressure information from a pressure sensor in a first master control loop wherein the pressure sensor is coupled to a vessel selected from the group consisting of a separator, a slugcatcher, and a free water knock-out vessel in the fluid processing system and the vessel is in fluid communication with a pipeline in the fluid processing system for conveying produced fluids such that the vessel receives the produced fluids from the pipeline;

b. receiving a pressure setpoint in the first master control loop;

c. receiving level information from a level sensor in a second master control loop wherein the level sensor is coupled to a vessel in the fluid processing system and the vessel is in fluid communication with a pipeline in the fluid processing system for conveying produced fluids such that the vessel receives the produced fluids from the pipeline;

d. receiving a level setpoint in the second master control loop;

e. receiving outputs of the first and second master control loops in a low signal selector;

f. determining the lower of the outputs of the first and second master control loops in the low signal selector to generate a low signal selector output;

g. receiving differential pressure information from a differential pressure sensing means for measuring differential pressure across a slug control valve in the slave control loop wherein the slug control valve has a percent opening in the pipeline upstream of the vessel;

h. receiving density information from a means for measuring or estimating density of the produced fluids in the pipeline in the slave control loop;

i. receiving current slug control valve percent opening information in the slave control loop;

j. calculating a calculated pseudo-flow rate for use in the slave control loop according to the equation:

$$Q=Cv\times\sqrt{(\Delta P/\rho)}$$

where:

i. Q=the calculated pseudo-flow rate of the produced fluids;

ii. Cv=a slug control valve coefficient dependent on the percent opening of the slug control valve;

iii. ΔP=the differential pressure across the slug control valve; and iv. ρ=the density of the produced fluids;

k. determining by the low signal selector output a pseudo-flow rate setpoint for controlling the slave control loop;

l. determining by the slave control loop whether the percent opening of the slug control valve should be modulated to achieve the pseudo-flow rate setpoint using the difference between the calculated pseudo-flow rate and the pseudo-flow rate setpoint; and m. reducing the volume and frequency of hydrodynamic slugs, terrain slugs or a combination of hydrodynamic slugs and terrain slugs in the fluid processing system by modulating the percent opening of the slug control valve responsive to the determination of the slave control loop.

19. A fluid processing system having reduced slugging volume and frequency, comprising:

a. a pipeline for conveying produced fluids;

b. a vessel selected from the group consisting of a separator, a slugcatcher, and a free water knock-out vessel in fluid communication with the pipeline for receiving the produced fluids;

c. a slug control valve having a percent opening in the pipeline;

d. a means for measuring or estimating density of the produced fluids in the pipeline;

e. a pressure sensor coupled to the vessel;

f. a level sensor coupled to the vessel;

g. a differential pressure sensing means for measuring the differential pressure across the slug control valve; and h. at least one processor;

wherein one of the at least one processor is in communication with the pressure sensor and the level sensor coupled to the vessel and is configured to include a first master control loop for receiving a pressure setpoint, a second master control loop for receiving a level setpoint, and a low signal selector for receiving outputs of the first and second master control loops and determining the lower of the outputs of the first and second master control loops in the low signal selector to generate a low signal selector output to determine a pseudo-flow rate setpoint for controlling a slave control loop; and wherein one of the at least one processor is in communication with the means for measuring or estimating density of the produced fluids, the differential pressure sensing means and the slug control valve and is configured to include the slave control loop to:

calculate a calculated pseudo-flow rate according to the equation:

$$Q=Cv\times\sqrt{(\Delta P/\rho)}$$

where:

i. Q=the calculated pseudo-flow rate of the produced fluids;

ii. Cv=a slug control valve coefficient dependent on the percent opening of the slug control valve;

iii. ΔP=the differential pressure across the slug control valve; and iv. ρ=the density of the produced fluids; and determine whether the percent opening of the slug control valve should be modulated to achieve the pseudo-flow rate setpoint using the difference between the calculated pseudo-flow rate and the pseudo-flow rate setpoint; and reducing the volume and frequency of hydrodynamic slugs, terrain slugs or a combination of hydrodynamic slugs and terrain slugs in the fluid processing system by modulating the percent opening of the slug control valve responsive to the determination of the slave control loop.

* * * * *